US005555637A

United States Patent [19]

Montagnino

[11] Patent Number: 5,555,637

[45] Date of Patent: Sep. 17, 1996

[54] DRYING APPARATUS

[75] Inventor: James G. Montagnino, El Paso, Tex.

[73] Assignee: Production Engineered Designs, Inc., El Paso, Tex.

[21] Appl. No.: 322,459

[22] Filed: Oct. 14, 1994

[51] Int. Cl.[6] ..... A45D 20/00

[52] U.S. Cl. ..... 34/97; 392/374; 392/385

[58] Field of Search ..... 392/379, 380, 392/383, 384, 385, 360, 373, 374; 34/96–101, 283

[56] References Cited

U.S. PATENT DOCUMENTS

| | | | |
|---|---|---|---|
| 2,514,528 | 7/1950 | Wahl . | |
| 3,365,811 | 1/1968 | Djenner . | |
| 3,599,345 | 8/1971 | Tolmie | 34/97 |
| 3,612,824 | 10/1971 | Berryman | 219/370 |
| 4,260,875 | 4/1981 | Waiter et al. | 219/364 |
| 5,265,348 | 11/1993 | Fleishman et al. | 34/97 |

*Primary Examiner*—Henry A. Bennett
*Assistant Examiner*—Susanne C. Tinker
*Attorney, Agent, or Firm*—Armstrong, Westerman, Hattori, McLeland & Naughton

[57] ABSTRACT

A drying apparatus such as a hand-held hair dryer comprising a housing including a nozzle and containing an air outlet and a fan assembly contained within the housing for generating a flow of air from the outlet. The apparatus further includes a flow guide including a plurality of holes therein contained within the nozzle, the flow guide forming a closed shape in cross-section and having open ends. The flow guide is separated from the nozzle so as to form a space between the nozzle and the flow guide for flow of air therethrough. The flow guide tends to attenuate noise generated by operation of the apparatus by lowering the frequency of the noise.

27 Claims, 4 Drawing Sheets

DRYING APPARATUS

The present invention generally relates to hot air type drying apparatus and, more particularly, to a hot air type drying apparatus having a flow channel for a flow of hot air which includes an exterior housing forming a nozzle and an interior guide member with holes therein, the guide member defining an annular space with the nozzle which helps to maintain the exterior housing at a reduced temperature relative to the temperature of the flow of hot air and also helps to attenuate noise generated by the flow of hot air flowing through the flow channel.

While the hot air type drying apparatus of the present invention will be primarily discussed hereinafter with reference to drying apparatus used for drying of hair and adapted for personal use, it should be recognized that their use and application are not thereby so limited. For example, the drying apparatus of the present invention may be utilized for larger scale drying of commodities, objects and the like by a flow of heated air. In addition, the drying apparatus of the present invention may be utilized in a portable apparatus for the application of a hot air stream for facilitating removal of paint, adhesives such as floor tile adhesives and the like which are commonly known as "heat guns" or the like and also as a space heater or atmospheric modifier for temperature and/or humidity modification by a hot air stream.

Small portable type hair drying apparatus are well known and are presently marketed in a wide variety of designs and styles. Such portable type hair drying apparatus generally comprise an electrical resistance heating element and a small electric fan both contained within a housing of polymeric or like material. Operation of the fan creates a flow ambient air which is directed across the heating element to thereby heat the air to an elevated temperature. The housing forms an elongated flow channel which guides the flow of heated air from the heating element and exhausts the air onto the specific portion of the body which is to be dried. The housing may be of the type which includes a hand or pistol grip such that the apparatus can be hand held. The housing may also be of the type which is adapted to exhaust the hot air into a flow channel and thence into bonnet worn over the head of the user. Typical examples of hand held portable hair drying type apparatus are shown and described in U.S. Pat. No. 2,514,528 to Wahl; U.S. Pat. No. 4,260,875 to Walter et al; U.S. Pat. No. 4,602,146 to Barns et al; and U.S. Pat. No. 5,148,512 to Owens.

A common problem associated with the use of conventional hair drying apparatus of the hand held type is that, since the housing itself forms at least a part of the flow channel for the heated air, this portion of the housing may be unacceptably hot to the touch. As often occurs, the user of such a drying apparatus may grasp the portion of the housing forming the flow channel during a drying procedure or in handling the apparatus after the drying procedure is complete such as in storage of the apparatus and the like. Contact with the relatively hot surface of the flow channel portion of the housing is uncomfortable to the user and may even present a safety hazard to the user due to the elevated temperature of the housing.

Another common problem associated with the use of conventional portable hair drying apparatus of both types is that the apparatus tend to produce an unacceptable amount of noise when in operation. The noise produced is due to a combination of a number of factors including the high rotational speed of the fan, the flow of hot air through the flow channel which exhausts the hot air from the apparatus, and the nature of the materials forming the flow channel. The sounds produced by such drying apparatus may be particularly annoying or unpleasant since the sounds are typically of a high frequency due to the high rotational speed of the fan and the relatively high air velocity produced in a constricted volume.

An additional problem associated with the operation of conventional hair dryers is that as air is caused to flow past the heating elements of the drying apparatus, portions of the air flow stream may be heated to a greater extent than other portions. This problem is especially acute in modern hair dryers which utilize high wattage heating elements thereby producing relatively high localized air temperatures and relatively high velocity air flows in which significant mixing of the air does not occur. Thus, as the heated air flow exits the dryer, portions of the air flow may be of unacceptably high temperature which may cause a safety hazard to the user.

SUMMARY OF THE INVENTION

It is therefore a feature of the subject invention to provide a drying apparatus of the type described above which utilizes a spaced interior flow guide member within the hot air flow channel of the housing for the apparatus so as to reduce the temperature of the exterior housing during use of the apparatus.

It is a further feature of the present invention to provide a drying apparatus which includes a spaced interior flow guide member within the flow channel for hot gases of the housing for the apparatus, the flow guide including a plurality of holes therein so as to attenuate noise generated by operation of the drying apparatus.

It is yet another feature of the present invention to provide a drying apparatus which includes a spaced interior flow guide member within the flow channel for hot gases of the housing for the apparatus, the flow guide including a plurality of holes therein so as to reduce the frequency of the sound generated by operation of the drying apparatus.

A further feature of the present invention to provide a drying apparatus which includes a spaced interior flow guide member within the flow channel for hot gases of the housing for the apparatus, the space between the flow guide and the flow channel being at least partially filled with a sound absorbing material so as to further reduce the sound generated by operation of the drying apparatus.

It is a further feature of the present invention to provide a drying apparatus which includes a spacer member located near the outlet of the nozzle portion of the apparatus, the spacer member including one or more vanes to promote mixing of the air within the airflow in the nozzle and thereby reduce localized high temperatures of the air.

It is another feature of the present invention to provide a improved drying apparatus for personal use in drying hair and the like which is of minimal complexity and thus minimal cost to manufacture and yields an apparatus which is economically feasible, of long life and relatively trouble free operation.

Briefly, in its broader aspects, the present invention comprehends a drying apparatus comprising a housing including a nozzle and containing an air outlet, a fan assembly contained within the housing for generating a flow of air from the outlet, and a flow guide including a plurality of holes therein contained within the nozzle, the flow guide forming a closed shape in cross-section and having open ends, the flow guide being separated from the nozzle so as to form a space between the nozzle and the flow guide for flow of air therethrough.

The present invention further comprehends a drying apparatus comprising a housing including a nozzle having a cross-sectional shape and containing an air outlet, a fan assembly contained within the housing for generating a flow of air from the outlet, and a flow guide including a plurality of holes therein contained within the nozzle, the flow guide having a cross-sectional shape similar to the cross-sectional shape of the nozzle and being separated from the nozzle so as to form a space between the nozzle and the flow guide.

In a further aspect, the present invention further comprehends a drying apparatus comprising a housing including a nozzle and containing an air outlet, a fan assembly contained within the housing for generating a flow of air from the outlet, and a spacer member adjacent to said air outlet, the spacer member comprising at least one vane extending across the air outlet so as to mix the flow of air from the outlet.

Further features, objects and advantages of the present invention will become more fully apparent from a detailed consideration of the arrangement and construction of the constituent parts as set forth in the following description when taken together with the accompanying drawings.

DETAILED DESCRIPTION OF THE PREFERRED EMBODIMENTS

Figure 1:
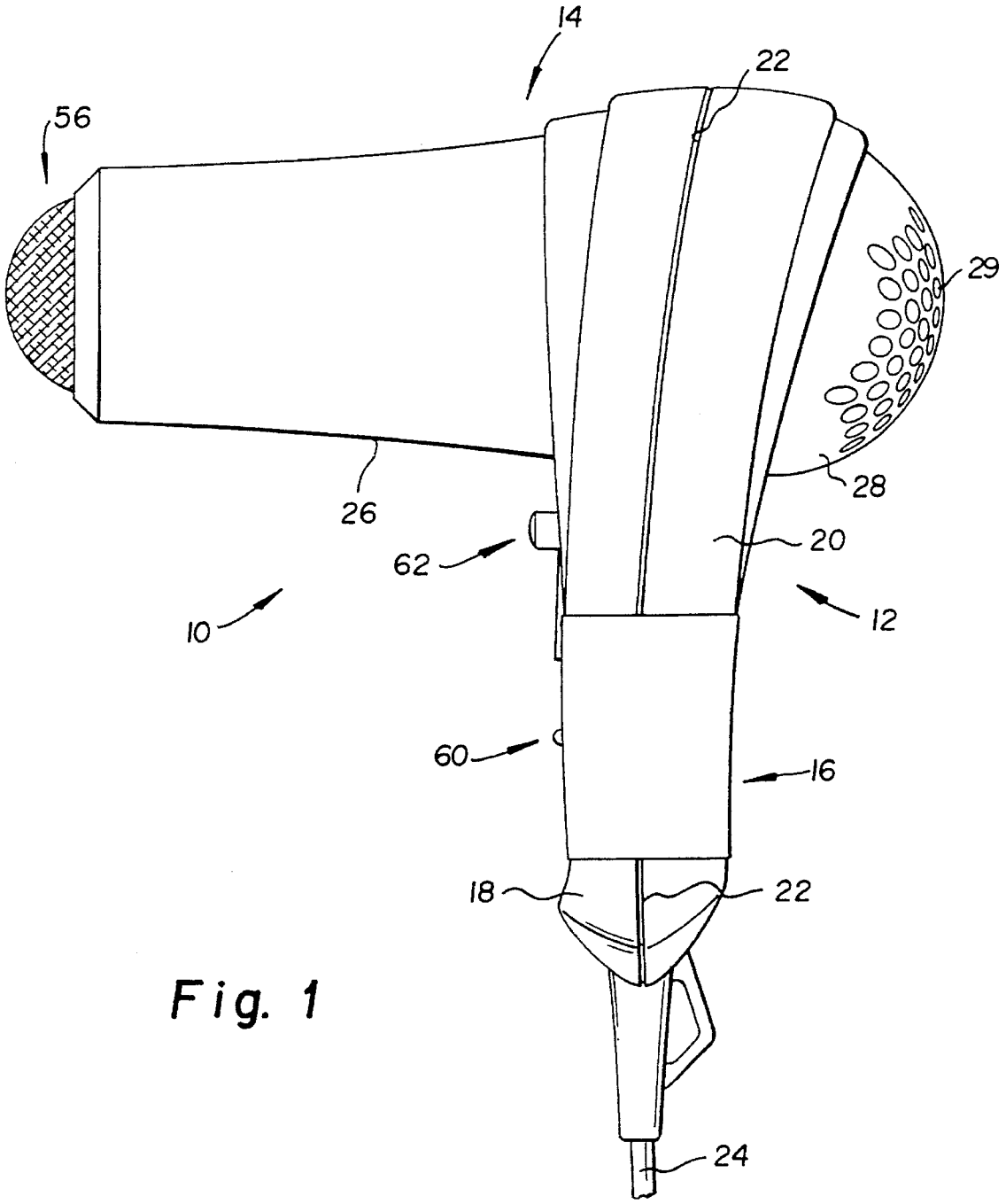
FIG. 1 is a side view of one embodiment of a drying apparatus embodying the concepts and principles of the present invention.

Turning first to FIG. 1 of the drawings, shown is a side view of a preferred embodiment of drying apparatus 10 in accordance with the present invention. In this embodiment, the exterior appearance of drying apparatus 10 is generally similar to a conventional portable or hand held hair dryer. That is, apparatus 10 includes housing 12 generally in the overall shape of a pistol or the like and includes body portion 14 and grip portion 16. Housing 12 is constructed of a polymeric material such as ABS, polycarbonate or like material which generally is the lowest possible weight while still providing sufficient structural rigidity and heat resistance for the apparatus.

In this particular embodiment, grip portion 16 of housing 12 is made of two mating members 18 and 20 which together form one or more hollow spaces therein for containing some of the operational components of the apparatus 10 as described hereinafter. Mating members 18 and 20 of grip portion 16 are joined together along mating line 22 by suitable means such as fasteners and the like. Extending from the lower part of grip portion 16 is electrical cord 24 for connecting apparatus 10 to a source of electrical current such as household current.

Body portion 14 of housing 12 comprises the upper portion of mating members 18 and 20, nozzle 26 and air inlet 28, all of which are of the previously mentioned polymeric material. As is apparent, nozzle 26 fits within an opening in the upper part of mating member 18 and air inlet 28 fits within an opposed opening in the upper part of mating member 20. Air inlet 28 includes a plurality of apertures 29 and may be provided with a small mesh screen (not shown) on the interior thereof which allows for the flow of air therethrough but prevents entry of foreign objects and the like into the interior of housing 12 through the apertures.

Figure 2:
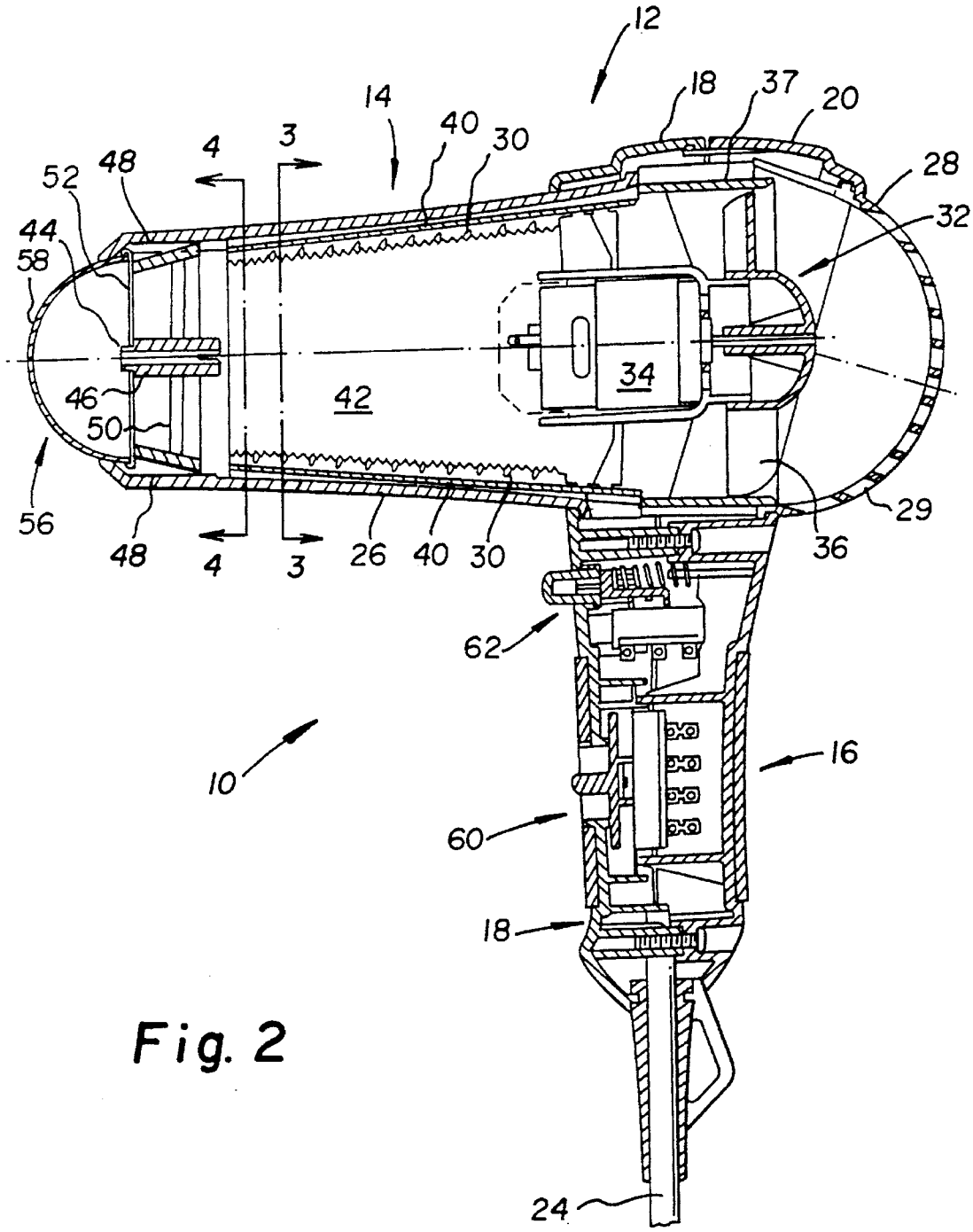
FIG. 2 is detailed side view, partially in cross-section, of the drying apparatus shown in FIG. 1.

Turning now to FIG. 2 which is a side view, partially in section, of apparatus 10 shown in FIG. 1, contained within nozzle 26 of body portion 14 of housing 12 is electrical resistance heating element 30 in the form of a coil which is electrically connected to cord 24 by suitable connectors (not shown). Heating element 30 may include one or more electrical resistance type heating wires and also may be electrically connected in series to a thermostat and/or fuse (not shown) to prevent overheating of the heating element and also to prevent the output of an overly hot air flow from the apparatus.

Positioned directly to one side of heating element 30 is electric fan assembly 32 comprising fan motor 34 and fan 36 capable of being driven by the fan motor and surrounded by fan shroud 37. The blades of fan 36 are oriented such that upon rotation of the fan by fan motor 34, a flow of air is generated toward fan motor 34 and across and around the coil of heating element 30. Nozzle 26 of housing 12 defines a generally circular air flow channel 38 extending from the outlet side of fan assembly 32. While flow channel 38 defined by nozzle 26 is shown to be generally in the configuration of a truncated cone in this embodiment, other cross sectional configurations such as square, rectangular, oval, cylindrical and the like may be utilized as well for the flow channel.

Located within flow channel 38 defined by nozzle 26 of housing 12 is flow guide 40 of the similar or the same general cross-sectional configuration as the nozzle. Thus, flow guide 40 is of generally tubular shape with open ends and has a generally closed cross-sectional configuration on a plane perpendicular to the longitudinal axis of the flow guide. As is illustrated, flow guide 40 is spaced a short distance from the interior surface of nozzle 26 so as to form an annular space or passage therebetween of generally uniform cross-sectional area. The end of flow guide 40 nearest to fan 36 is slightly smaller in diameter than outer shroud 37 about the fan such that air flow generated by the fan flows on both sides of the flow guide. That is, the air flow generated by fan 36 is divided into two flow portions by flow guide 40, one air flow portion passing through the annular space between nozzle 26 and the flow guide and the other air flow portion passing within the confines of the flow guide. As is apparent, the latter air flow portion will be heated to a greater extent by heating element 30 and thus will be warmer than the former air flow portion.

Figure 3:
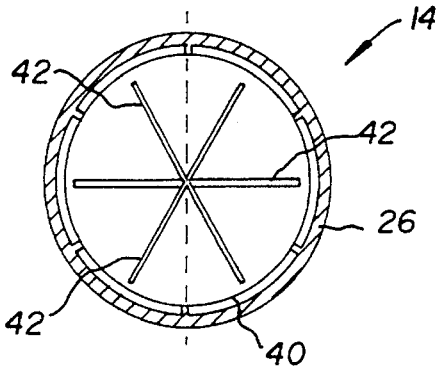
FIG. 3 is a sectional view of the air flow channel of the drying apparatus shown in FIGS. 1 and 2 taken along line 3—3 of FIG. 2 which illustrates the cross-sectional configuration of the flow guide within the channel.

Secured within the interior of flow guide 40 are a plurality of planar guide members 42 which divide the interior volume or channel defined by the flow guide into a plurality of separate flow paths. As is shown in FIG. 3, three guide members 42 are utilized in this embodiment, the guide members being equally spaced about the internal periphery of flow guide 40. Guide members 42 have cooperating slots (not shown) extending along the longitudinal axis of nozzle 26 which allow the guide members to be assembled in the configuration shown. Heating element 30 in the general form of a coil is supported by the assemblage of guide members 42 by being wound about the outer periphery of the assemblage and held in position by cooperation with notches contained in an outer edge of the guide members. Due to the close proximity of heating element 30, guide members 42 are typically made of high temperature resistant material such as mica or the like.

Positioned in the open end of nozzle 26 is spacer member 44 which includes central hub 46 for supporting and retaining guide members 42 within the nozzle. Hub 46 includes a plurality of slots into which the ends of guide members 42 project. Spacer member 44 further includes a rim portion 48 of approximately the same outer diameter as the interior surface of nozzle 26 and a plurality of vanes 50 connecting hub 46 to rim portion 48.

Figure 4:
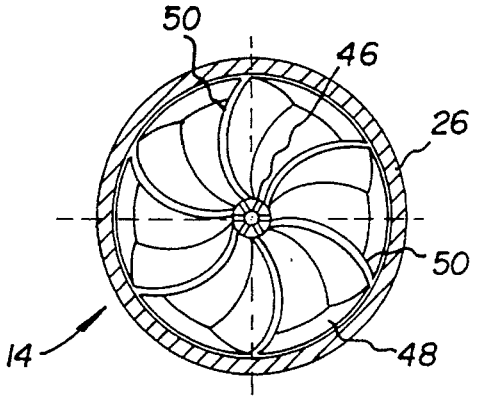
FIG. 4 is a sectional view of the flow channel of the drying apparatus shown in FIGS. 1 and 2 taken along line 4—4 of FIG. 2 which illustrates a configuration of a spacer positioned within the flow channel.

As is best shown in FIG. 4, vanes 50 of spacer member 44 preferably are of a curved configuration and are oriented with their major surfaces such as to impart a swirl or spin to the flow of air therethrough. As a consequence of the swirl or spin imparted to the flow of air by vanes 50, mixing and blending of the cooler air flow from the annular space about flow guide 40 and the warmer air from the flow channel is enhanced as well as mixing and blending of the warmer air itself. As a consequence of this mixing of the air flows, the air exiting from nozzle tends to be of uniform in temperature across the whole cross-section of the outlet of nozzle 26 and thus discrete "hot spots" in the air output which may be hazardous tend to be avoided.

The number and configuration of vanes 50 contained in spacer member 44 may vary considerably. Generally, the number of vanes 50 should be sufficient to create the desired mixing of the air flows without creating undesirable pressure drop. While vanes 50 are shown as having a generally semi-circular configuration when viewed along the axis of spacer member 44, other configuration for the vanes could also be used as long as the vanes create sufficient disturbance of the air flows to promote mixing thereof. The degree to which the major surfaces of vanes 50 are normal to the air flow is dependent upon the amount of mixing required to be generated balanced against the pressure drop created.

Preferably, as shown in FIG. 2, the inner surface of rim portion 48 of spacer 44 forms a constricting surface which gradually decreases in diameter along the longitudinal axis of nozzle 26 in the direction of the outlet of the nozzle. This converging inner surface of rim portion 48 of spacer 44 also aids in the mixing and blending of the cooler air flow from the annular space between nozzle 26 and flow guide 40 with the warmer air flow within the flow guide. The converging inner surface of rim portion 48 of spacer 44 further tends to increase the velocity of the air flow from the outlet of nozzle 26.

Releasably mounted at the open end of flow channel 38 formed by nozzle 26 of housing 12 is flange 52 having wire mesh thereover which helps to maintain the shape and provide structural rigidity for nozzle 26 and also helps to prevent the ingress of foreign objects into the nozzle. Mounted about the exterior of flange 52 on the end of nozzle 26 is diffuser 56 which, in this embodiment, comprises a dome shaped cap 58 of wire mesh having a plurality of very small holes therein for passage of the heated air from apparatus 10. Other types of diffusers could be used equally as well or, in some instances, no diffuser is necessary or desirable.

Contained within grip portion of housing 12 are the operational controls of apparatus 10 which may vary considerably, but such controls generally include an on-off switch and optionally a speed control for the fan and, a variable control for the heating element. In the embodiment shown, grip portion 16 includes switch assembly 60 which includes electrical switch for controlling electrical power supplied through cord 24 to heating element 30 and to fan assembly 32. Switch assembly 60 in this embodiment provides two operational positions, one for low speed-low heat and one for high speed-high heat. Other operational controls could be used equally as well to provide greater or less control over the operation of the apparatus in terms of fan speed, heat output and the like.

Preferably, grip portion 16 of housing 12 further contains a second switch assembly 62 commonly termed a "cool shot" switch. Typically, this switch assembly 62 is spring loaded and allows the user to selectively interrupt the flow of electrical current to the heating element so that the apparatus produces a flow of air at or near ambient temperature for a desired length of time. In addition, operation of the switch assembly 62 may also change the speed of fan 36 so that the amount of air flow through the apparatus is altered, generally the amount of air flow being decreased by operation of the switch. Such a controlled amount air flow of reduced temperature produced by operation of switch assembly 62 may be useful in certain hair drying or styling operations.

Figure 5:
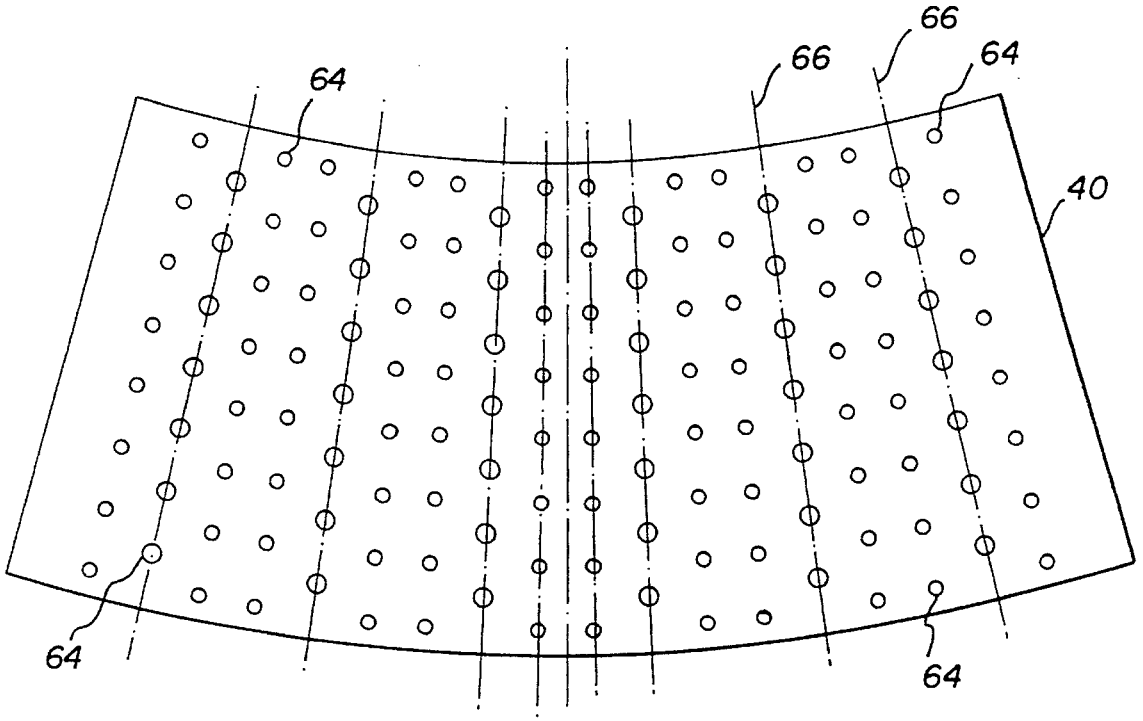
FIG. 5 is a top plan view of a flow guide before the guide is formed into a generally cylindrical flow guide and which illustrates one embodiment of the size and placement of holes contained therein for attenuating noise generated by operation of a drying apparatus.

As is best shown in FIG. 5, flow guide 40 includes a plurality of holes 64 which are of a size and location relative to each other to attenuate, alter or modify noise or sound generated by the apparatus, particularly the noise generated by fan motor 34 and fan 37 as well as the flow of air through body portion 14 of housing 12. For the purpose of greater clarity, flow guide 40 is shown in FIG. 5 in a flat condition rather than cylindrical or like configuration as the flow guide is installed within nozzle 26 of housing 12.

In this particular embodiment of flow guide 40 shown in FIG. 5, holes 64 are formed in rows 66 extending generally parallel to the longitudinal axis of the completed flow guide as positioned within nozzle 26, the holes being equally spaced from adjacent holes within the same row. The spacing between adjacent rows 66 of holes 64 also is generally equal for all rows thus forming a regular pattern of holes. Every fourth row 68 contains holes 64 of slightly larger diameter than the holes of adjacent rows and these larger holes are offset along the longitudinal axis of flow guide 40. It is to be noted that flow guide 40 in this embodiment is not cylindrical when formed about itself but rather has the shape of a truncated cone. Thus, the rows of holes 64 in this embodiment are not parallel to each other but rather are slightly diverging from inlet to outlet.

For a portable hand-held hair dryer of conventional size of about 200 mm in length from inlet to air outlet and having a flow channel of about 125 mm in length and an average diameter of about 50 mm according to the present invention, it has been found, for example, that a regular pattern of smaller holes of about 3 mm in diameter and larger holes of about 4 mm in diameter with a spacing in each of the rows of about 12 mm and a row spacing (centerline to centerline) of about 10 mm minimum provides more than satisfactory noise attenuation.

As a general matter, the shape, size and spacing of the holes 64 formed in flow guide 40 may vary considerably and generally may be specifically adapted for the particular apparatus according to, among other things, the side of the apparatus, the speed(s) of the air flow through the apparatus, temperature(s) of the air in the flow, the contour of the flow path of the air flow including any interferences, the materials utilized, and the like. Although holes 64 of a circular shape as shown are presently preferred, holes of any geometric shape may be used such as oval, diamond and square shapes. While there presently is no set formula for determining an ideal hole pattern and hole size of the flow guide to maximize noise attenuation, the selection of an appropriate hole pattern and associated hole size generally follows similar concepts employed in the design of mufflers which cancel sound waves by interference. This particular concept relies upon breaking waves into parts following different paths that meet again out of phase before leaving the confines of the muffler.

It is to be recognized that the primary purpose of holes 64 contained in flow guide 40 and their arrangement relative to one another is not necessarily to reduce the noise level of the apparatus such as in terms of decibels. Rather, the primary purpose of the holes 64 in the flow guide 40 is to lower the frequency of the noise produced by the apparatus 10 as higher frequency sounds emanating from the apparatus tend to be more annoying and more objectionable to the user of the apparatus.

In operation of the above described drying apparatus according to the present invention, the user of apparatus 10 grasps grip portion 16 of housing 12, activates switch assembly 60 and directs hot air emanating outwardly from nozzle 26 to the particular area of an object to be dried by the hot air. During this operation, activation of fan 36 occurs and thus ambient air is drawn in through apertures 29 in the rear of air inlet 28 in housing 12 and passes through fan assembly 32. A portion of the air flow, preferably a majority of the air flow, exiting the fan is forced into contact with heating element 30 by flowing through channel within flow guide 40. The remaining generally smaller portion of the air flow generated by fan assembly 32 flows about the exterior of flow guide 40 into the annular flow space defined by nozzle 26 and the flow guide. Since this air flow through this annular space is not heated significantly by heating element 30, the air flow into the space tends to keep the exterior of nozzle 26 cooler and thus more comfortable upon contact with the user and thus less of a safety hazard. The pattern of holes 64 in flow guide 40 tends to attenuate noise created by fan motor 34 and fan 36 as well as the flow of air through the apparatus by, among other things, lowering the frequency thereof and thereby provides a significantly improved operation for the apparatus.

Figure 6:
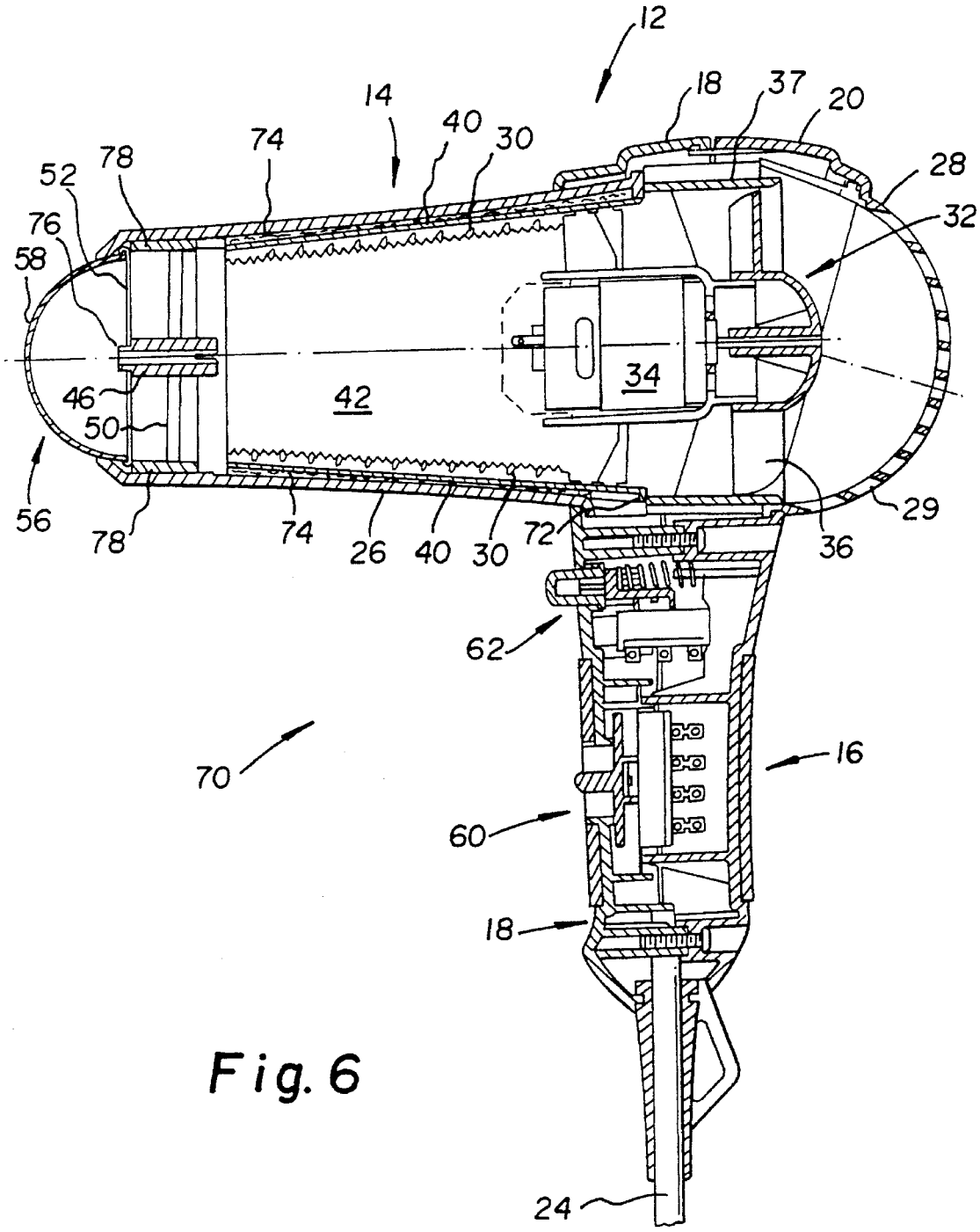
FIG. 6 is a detailed side view, partially in cross-section, of another embodiment of a drying apparatus embodying the concepts and principles of the present invention.

Turning now to FIG. 6, shown is a detailed side view, partially in cross-section, of drying apparatus 70 which is another embodiment of a drying apparatus embodying the concepts and principles of the present invention. For convenience and clarity, the same reference numerals are used in this figure for like components as shown in FIGS. 1–5 and additional descriptions of these like components are omitted for the purpose of brevity.

Basically, drying apparatus 70 shown in FIG. 6 differs from the embodiment previously described in at least two important respects. First, the space defined by the inner wall of nozzle 26 and flow guide 40 is closed by wall portion 72 at the end of the flow guide adjacent to fan assembly 32. As a consequence, unlike the embodiment of the previous figures, operation of fan 36 does not create a flow of air within this space.

Instead, the space defined by nozzle 26 and flow guide 40 is at least partially filled with sound absorbing or deadening material 74. Preferably, the space is completely filled with sound absorbing material 74. Suitable sound absorbing materials 74 include fibrous inorganic materials such as fibrous glass, mineral wools, granules and the like, and polymeric materials, particularly expanded or foamed polymeric materials. The latter materials may either a unitary foamed or expanded structure or structures, or a plurality of discrete structures such as balls, chips, flakes, granules or other shapes of a size sufficient so as not to pass through the holes in flow guide 40. The inclusion of sound absorbing material 74 in the space defined by nozzle 26 and flow guide 40 tends to further reduce objectionable sound or noise created by operation of drying apparatus 70.

Second, spacer member 76 in this embodiment, while quite similar in structure and function to previously described spacer member 44, has rim portion 78 which is different in configuration than rim portion 48 of spacer member 44. As is shown, the inner surface of rim portion 78 extends generally parallel with the interior surface of nozzle 26 and thus does not converge along the longitudinal axis of the nozzle. As a consequence of this construction for rim portion 78, the velocity of the air flow through spacer member is not appreciably altered by spacer member itself. Such an effect may be advantageous in certain applications of drying apparatus 70, particularly when the apparatus is used as a heat gun, where an increased air velocity is not desired or particularly beneficial.

While there has been shown and described what is considered to be preferred embodiment of the present invention, it will be apparent to those skilled in the art to which the invention pertains that various changes and modification may be made therein without departing from the invention as defined in the appended claims.

It is claimed:

1. A drying apparatus comprising a housing including a nozzle having a cross-sectional shape and containing an air outlet, a fan assembly contained within the housing for generating a flow of air from the outlet, and a flow guide of tubular shape contained within the nozzle, the flow guide having a cross-sectional shape similar to the cross-sectional shape of the nozzle and being separated from the nozzle so as to form a space between the nozzle and the flow guide, the flow guide comprising a continuous member having a plurality of spaced, generally circular holes therein, the holes having a size and location relative to each other to cancel by interference sound waves generated by the fan assembly and thereby attenuate noise generated by the fan assembly.

2. A drying apparatus in accordance with claim 1, wherein the holes of the flow guide are in a regular pattern.

3. A drying apparatus in accordance with claim 2, wherein the holes of the flow guide are of differing sizes.

4. A drying apparatus in accordance with claim 3 wherein the holes in the flow guide are arranged in a plurality of rows.

5. A drying apparatus in accordance with claim 2 wherein the holes in the flow guide are arranged in a plurality of rows.

6. A drying apparatus in accordance with claim 5, wherein each row is spaced equally from adjacent rows and the holes in each row are equally spaced from adjacent holes.

7. A drying apparatus in accordance with claim 2, wherein the holes of the flow guide are circular.

8. A drying apparatus in accordance with claim 1, further including a heater for heating an air flow generated by operation of the fan assembly.

9. A drying apparatus in accordance with claim 1, wherein the cross-sectional shape of the flow guide is circular.

10. A drying apparatus in accordance with claim 1, wherein the space between the nozzle and the flow guide contains a sound absorbing material.

11. A drying apparatus in accordance with claim 10, wherein the sound absorbing material is selected from the group consisting of inorganic materials and foamed polymeric materials.

12. A drying apparatus in accordance with claim 10, wherein the sound absorbing material includes fibrous glass.

13. A drying apparatus comprising a housing including a nozzle and containing an air outlet, a fan assembly contained within the housing for generating a flow of air from the outlet, and a flow guide contained within the nozzle, the flow guide forming a closed tubular shape in cross-section and having open ends, the flow guide being separated from the nozzle so as to form a space between the nozzle and the flow guide for flow of air therethrough, the flow guide comprising a continuous member having a plurality of spaced, generally circular holes therein, the holes having a size and location relative to each other to cancel by interference sound waves generated by the fan assembly and thereby attenuate noise generated by the fan assembly.

14. A drying apparatus in accordance with claim 13, wherein the holes of the flow guide are in a regular pattern.

15. A drying apparatus in accordance with claim 14, wherein the holes of the flow guide are of differing sizes.

16. A drying apparatus in accordance with claim 15, wherein the holes are circular.

17. A drying apparatus in accordance with claim 16 wherein the holes in the flow guide are arranged in a plurality of rows.

18. A drying apparatus in accordance with claim 14 wherein the holes in the flow guide are arranged in a plurality of rows.

19. A drying apparatus in accordance with claim 18, wherein each row is spaced equally from adjacent rows and the holes in each row are equally spaced from adjacent holes.

20. A drying apparatus in accordance with claim 14, wherein the cross-sectional shape of the flow guide is circular.

21. A drying apparatus in accordance with claim 13, further including a heater for heating an air flow generated by operation of the fan assembly.

22. A drying apparatus comprising a housing including a nozzle and containing an air outlet, a fan assembly contained within the housing for generating a flow of air from the outlet, and a spacer member adjacent to said air outlet, the spacer member comprising at least one vane extending across the air outlet so as to mix the flow of air from the outlet.

23. A drying apparatus in accordance with claim 22, wherein the spacer member includes a plurality of vanes of the same configuration.

24. A drying apparatus in accordance with claim 22, wherein the air outlet of the nozzle has a cross-sectional shape and the spacer member further includes a rim portion having a cross-sectional shape the same as the shape of the air outlet.

25. A drying apparatus in accordance with claim 24, wherein an inner surface of the rim portion of spacer member forms a constricting surface which decreases in diameter along the longitudinal axis of nozzle in the direction of the outlet of the nozzle.

26. A drying apparatus in accordance with claim 24, wherein the spacer member further includes a hub, the vane extending from the hub to the rim portion.

27. A drying apparatus in accordance with claim 26, wherein the spacer member includes a plurality of vanes extending from the hub to the rim portion.

* * * * *